US007845923B2

(12) United States Patent
Lennemann et al.

(10) Patent No.: US 7,845,923 B2
(45) Date of Patent: Dec. 7, 2010

(54) SPINNING, DRAWING AND TEXTURING MACHINE

(75) Inventors: Friedrich Lennemann, Neumunster (DE); Matthias Schemken, Neumunster (DE); Stefan Kalies, Hoffeld (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/262,499

(22) Filed: Oct. 31, 2008

(65) Prior Publication Data

US 2009/0049669 A1 Feb. 26, 2009

Related U.S. Application Data

(63) Continuation of application No. PCT/EP2007/003926, filed on May 4, 2007.

(30) Foreign Application Priority Data

May 8, 2006 (DE) ..... 10 2006 021 292

(51) Int. Cl.
*D01D 5/092* (2006.01)
*D01D 7/00* (2006.01)

(52) U.S. Cl. ..... 425/66; 425/72.2; 425/88; 425/213; 425/377; 425/382.2; 425/404; 425/445; 425/464

(58) Field of Classification Search ..... 425/66, 425/72.2, 88, 213, 377, 382.2, 404, 445, 425/464

See application file for complete search history.

(56) References Cited

U.S. PATENT DOCUMENTS 3,582,783 A * 6/1971 Hendrickson ..... 340/825.58
4,023,743 A * 5/1977 Schippers ..... 242/473.6
4,043,718 A * 8/1977 Takenaka et al. ..... 425/72.2
4,305,551 A * 12/1981 Cockshott et al. ..... 242/473.4
6,406,650 B1 6/2002 Gross et al.
6,447,703 B1 * 9/2002 Waddington et al. ..... 264/103
2003/0068394 A1 * 4/2003 Kirchhoff ..... 425/66
2009/0041880 A1 * 2/2009 Lennemann et al. ..... 425/88

FOREIGN PATENT DOCUMENTS

DE 858005 C 12/1952
DE 3343714 A1 6/1984
DE 4406995 9/1994
DE 19505838 A1 * 9/1995
DE 10009335 A1 9/2000

(Continued)

OTHER PUBLICATIONS

Fourne, F., "Synthetische Fasern", Carl Hanser Verlag, Munchen, 1995, pp. 279-285.

*Primary Examiner*—Yogendra N Gupta
*Assistant Examiner*—Joseph Leyson
(74) *Attorney, Agent, or Firm*—BainwoodHuang

(57) ABSTRACT

A spinning, drawing and texturing machine for the production of curled threads includes a spinning unit and multiple machine modules associated with the spinning unit. Each of the machine modules has multiple processing assemblies for drawing and curling one of the threads, and a spooling unit for winding the thread. The machine modules positioned next to one another form a longitudinal side of the machine. The processing assemblies and the spooling unit are arranged among each other at one of the machine modules such that a narrow machine partition (T) in a range of <800 mm occurs on the longitudinal side of the machine. The spinning unit has one or more spinnerets and one spinning duct within the machine partition (T) per machine module. The spinnerets are held in rows parallel to the longitudinal side of the machine.

20 Claims, 4 Drawing Sheets

FOREIGN PATENT DOCUMENTS

| | | | |
|---|---|---|---|
| DE | 10039093 | A1 | 3/2001 |
| DE | 10045473 | A1 | 3/2002 |
| DE | 102006010855 | A1 | 9/2007 |
| EP | 0350450 | A | 1/1990 |
| EP | 0718424 | A2 | 6/1996 |
| EP | 1035238 | A1 | 9/2000 |
| EP | 1300496 | A | 4/2003 |
| FR | 2286895 | A1 | 4/1976 |

* cited by examiner

SPINNING, DRAWING AND TEXTURING MACHINE

CROSS REFERENCE TO RELATED APPLICATIONS

This patent application is a Continuation of International Patent Application No. PCT/EP2007/003926 filed on May 4, 2007, entitled "SPINNING, DRAWING AND TEXTURING MACHINE", the contents and teachings of which are hereby incorporated by reference in their entirety.

FIELD OF THE INVENTION

Embodiments of the invention relate to a spinning, drawing and texturing machine for the production of curled threads.

BACKGROUND

A spinning, drawing and texturing machine is known, for example, from EP 0 718 424 A1.

In the known spinning, drawing and texturing machine, the processing assemblies arranged below a spinning device for drawing and curling the threads, and the winding units are each combined into individual machine modules. Inside of the machine modules the processing assemblies, in particular, are arranged such that a thread guide that is aligned substantially horizontally is predominant. Therefore, very wide machine modules are required depending on the treatment steps, which lead to a correspondingly large machine partition. However, such large machine partitions generally have the advantage, particularly in the case of a single thread processing guide, that the spinnerets necessary for melt spinning must also be held at larger distances to one another within the heatable spinning beam. Such spinning units, however, have a greater energy requirement in order to perform a continuous heating of the melt carrying components across the entire length of the machine. In this regard, the requirements with respect to a large utilization of space and low energy consumption common today cannot be met.

In order to obtain a large utilization of space for the production of a plurality of threads, such spinning, drawing and texturing machines are also known, wherein the threads spun in parallel next to each other are guided via the processing assemblies arranged beneath the spinning unit in order to subsequently mutually be wound to one spool in parallel next to another on one spool spindle. Such a spinning, drawing and texturing machine is known, for example, from printed publication EP 103 52 38 A1. In such systems multiple threads are guided as one thread group per spinning position, treated, and wound. In case one of the threads of the thread group tears during the treatment or during winding, the process guiding of the adjacent threads is automatically interrupted so that the entire spinning position is interrupted.

In contrast to the above the spinning, drawing and texturing machine known from EP 1 300 496 A1 already has the advantage that the threads within the spinning positions are each wound to spools in the individual winding stations. The processing assemblies arranged between the winding unit and the spinning unit, however, are provided for guiding multiple threads so that an individual guiding of the threads within the spinning position is not possible.

SUMMARY

It is an object of the invention to create a spinning, drawing and texturing machine of the generic type, wherein a number of threads that is as large as possible can be flexibly produced in as little space as possible, even with a single thread guide.

Another object of the invention is to provide a spinning, drawing and texturing machine of the type named above, by means of which an automated production of curled threads is possible.

This object is solved according to the invention by means of a spinning, drawing and texturing machine in that the processing assemblies and the spooling unit are arranged beneath one another on the machine modules such that a narrow machine partition in the range of <800 mm occurs on the longitudinal side of the machine, and that the spinning unit has one or more spinnerets and a spinning duct within the machine partition, wherein the spinnerets are held in rows parallel to the longitudinal side of the machine.

Advantageous improvements of the invention are defined by certain characteristics and characteristics combinations.

The invention departs from the currently common system concept of melt spinning of a plurality of threads, wherein multiple threads are simultaneously produced in parallel in one spinning position. The spinning, drawing and texturing machine according to the invention introduces the partition brought about by the machine modules further into the spinning unit such that only one thread is produced per spinning position. For this purpose the thread within the spinning position can consist of a melt spun filament bundle and be formed of multiple individual filament bundles, such as with the production of composite threads. The partition of the machine carried out per thread from the spooling unit to the spinneret has the particular advantage that substantially less thread waste is created with the production of a plurality of threads having a plurality of spinning positions. In this manner the machine partition in the region of the spinning unit results in the fact that no so-called sympathy breakages occur in case the thread breaks. Only the thread produced in the spinning position is affected; the adjacent threads in adjacent spinning positions remain unaffected. This results in a higher availability of the entire system, since only one thread is affected, such as in case of maintenance or cleaning work. Furthermore, no long protruding processing assemblies are required, particularly for drawing, texturing, and winding.

Since the narrow machine partition leads to a slim and tall construction design of the machine, the improvement of the invention is preferably embodied such that a heightened operator isle is configured immediately in front of the machine modules, which extends substantially across the entire length of the longitudinal side of the machine. In this manner all positions embodied next to each other may be controlled by an operator from one single operator isle.

In a fully automated spool handling the invention provides particularly the improvement, wherein the operator isle is embodied at a plane above the spooling units, and wherein a doffer unit is associated with the spooling units for the removal and transport of the spools. In this manner the fully automated spool exchange and spool transport can be carried out at a lower level, in which no access occurs by means of an operator. In this regard a high degree of safety requirements is met so that an operator performs controls exclusively from the operator isle that is guided above the doffer unit in the case of a semi-automated machine.

In order to achieve a high flexibility for removing and exchanging the spools in the spooling units, a preferred improvement of the spinning, drawing and texturing machine provides to drive and control the spooling units of the machine modules independently of each other, wherein each spooling unit only winds one thread each onto a spool.

In order to enable a continuous thread guide without any interruption, the spooling units are each embodied having two drivable spool spindles, which are usually held on a rotating carrier, and can thereby be guided into an operating region and an exchanging region in an alternating manner.

In these cases the doffer units in particular have proven to be especially suitable, wherein a stationary spool changing device is associated with each spooling unit, which interacts with a spool transporting unit.

It should be noted at this point that other doffer systems having mobile doffers may also be utilized in order to be able to remove the spools from the spooling units.

In order to be able to carry out operating and maintenance work independently of adjacent machine modules, the improvement according to the invention is particularly advantageous, wherein the processing assemblies of the machine modules can be driven and controlled independently of each other. In this manner the production of the threads can be individually controlled and regulated.

In this regard the improvement has proven particularly useful, wherein one electronic component is embodied per machine module for receiving the processing assemblies and the drive and control electronic system associated with the spooling unit. This results in a very flexible construction of the entire spinning, drawing and texturing machine, wherein the individual positions are exchangeable for the production of the threads.

For this purpose the embodiment of the spinning, drawing and texturing machine according to the invention has been proven particularly user friendly, wherein the electronic components each have a remote control unit, and the control units can be controlled separately via a mobile operating unit. In this manner the processing assemblies and the spooling unit of a machine module can be operated by an operator even from larger distances. The adjustment corrections of individual processing parameters can be carried out, or individual monitoring and control functions can be performed in this manner. Furthermore, the actual data of the position can also be displayed and documented.

In order to obtain an arrangement of the processing assemblies that is as user friendly as possible, the machine modules each have a rack wall, on which the processing assemblies and the spooling unit are held below one another. In this manner a partition between the thread guiding components and the drives and electronic components can also be carried out such that the drive and the control are embodied on a rear of the rack wall, and the component assemblies required for the guiding of the thread are held at a front of the rack wall.

The improvement of the spinning, drawing and texturing machine according to the invention, wherein a suction device is associated with the machine modules, wherein the suction devices for each machine module each have an intake connected upstream of the processing assemblies, is particularly suited for the automation of the entire production process. An automated separating of the thread can be carried out within the processing assemblies with a winding formation, which is then continuously discharged to a refuse bin via the suction device. Thus, the switching off of the spinning position is not necessary. The spinnerets remain in operation such that the production process can be resumed very quickly after removing the winding.

For automating the spinning, drawing and texturing machine according to the invention, a robot arranged on the longitudinal side of the machine in a movable manner is provided, wherein the robot performs the starting of one or multiple threads at the process start and/or after process interrupting using a movable robot arm. This enables a fully automated operation of the spinning, drawing and texturing machine.

In order to be able to operate the machine modules embodied within a longitudinal side of the machine the robot is held on a movable carrier, wherein the carrier can be guided at a vertical plane parallel to the longitudinal side of the machine. For this purpose the carrier is equipped with drives enabling both a vertical and a horizontal movement in a plane such that the robot receives an additional degree of freedom in addition to the robot arm normally embodied having multiple axes.

For this purpose, all components common for the thread guide, treatment, curling, and guiding may be utilized as processing assemblies. Preferably, the processing assembly is formed by at least two driven godets for drawing the thread.

In order to be able to carry out many functions using as few processing assemblies as possible, the first godet is preferably used in order to withdraw the thread from the spinning unit.

The spinning, drawing and texturing machine according to the invention is particularly suited to produce multi-color carpet fibers, wherein the curled thread is formed of a plurality of individual threads. Generally, however, individual threads may also be spun, drawn, curled, and wound to a spool within one position.

BRIEF DESCRIPTION OF THE DRAWINGS

The invention is explained in further detail below based on a few example embodiments of the spinning, drawing and texturing machine according to the invention with reference to the attached figures.

They show.

Figure 2:
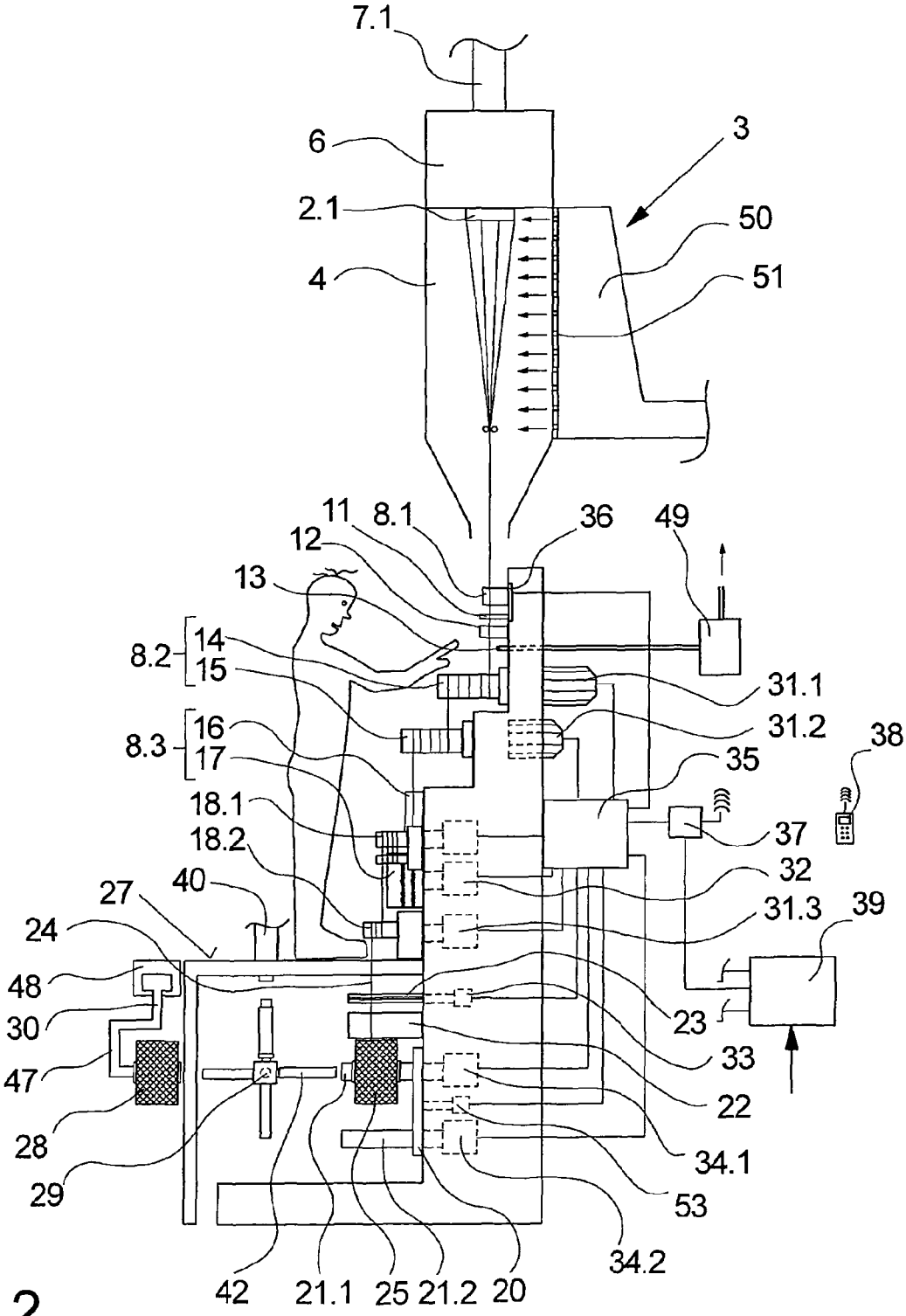

FIG. 2 which are schematic views of a first example embodiment of a spinning, drawing and texturing machine according to the invention, and

FIG. 3 and

Figure 4:
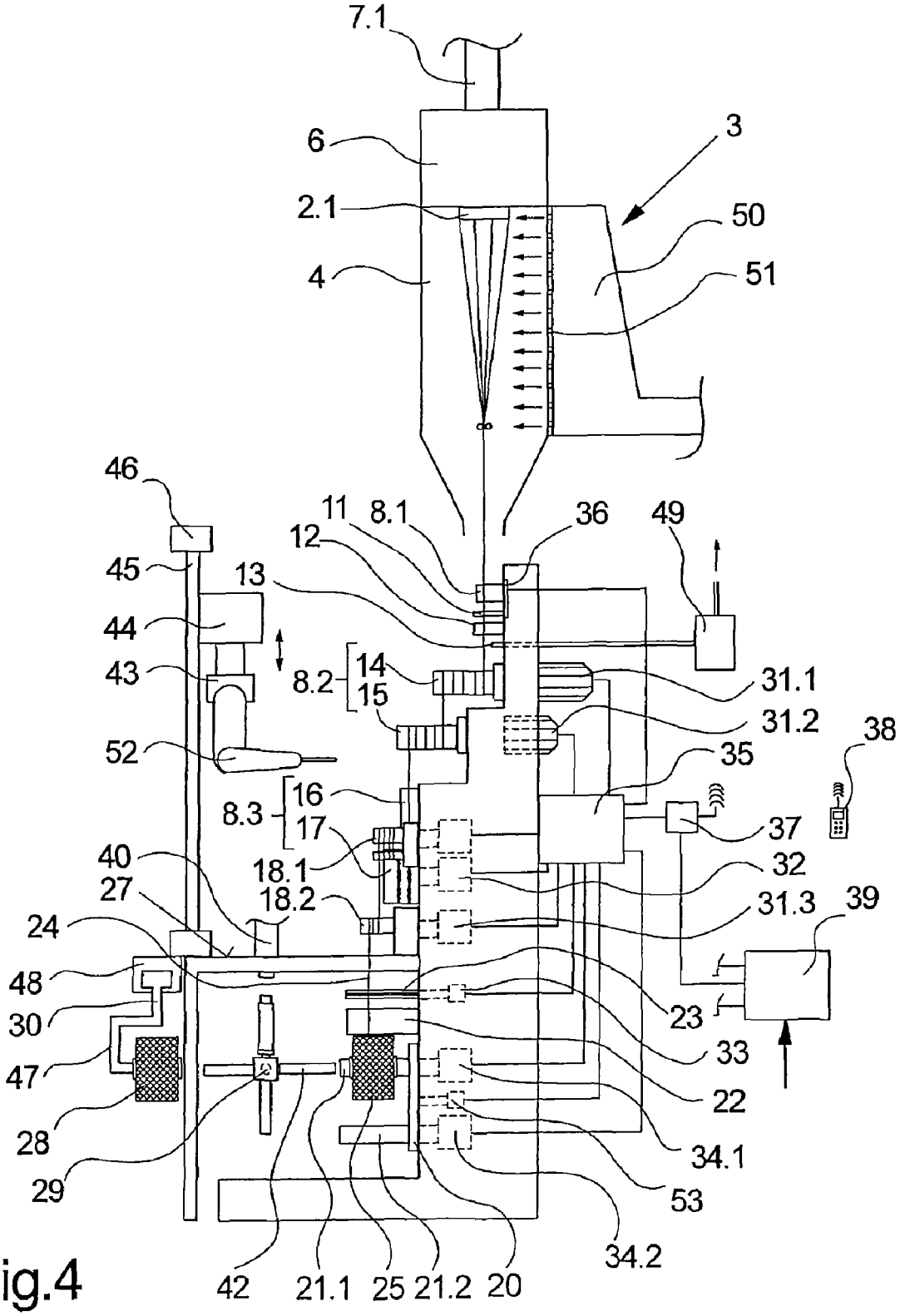

FIG. 4 which are schematic views of a further example embodiment of a spinning, drawing and texturing machine according to the invention.

DETAILED DESCRIPTION

Figure 1:
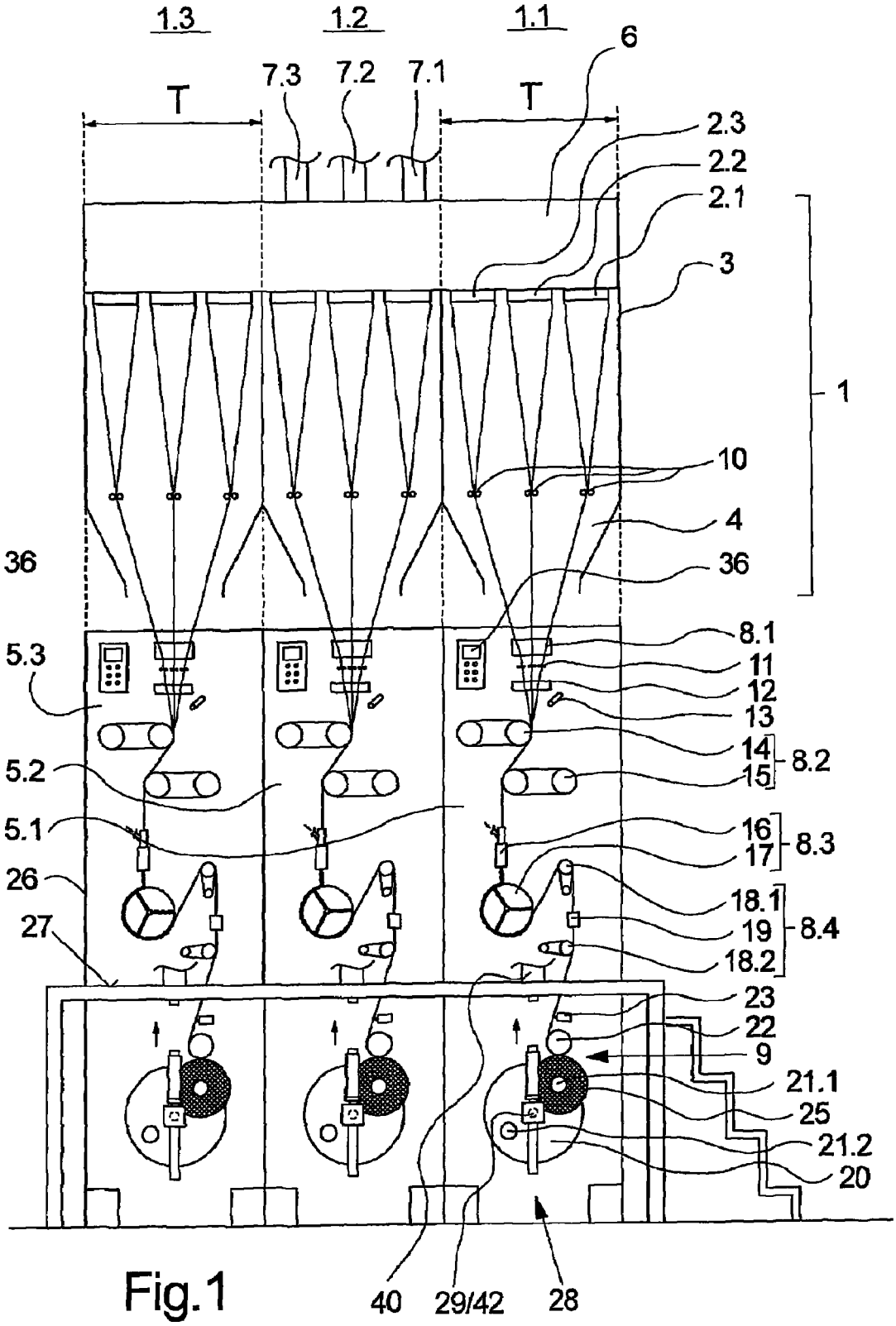
FIG. 1.

FIG. 1 and FIG. 2 show a first example embodiment of the spinning, drawing and texturing machine according to the invention. FIG. 1 schematically illustrates a front view, and FIG. 2 schematically illustrates a side view of the spinning, drawing and texturing machine. If no express reference is made to any of the figures, the following description applies to both figures.

The spinning, drawing and texturing machine in this example embodiment is formed by means of a spinning unit 1, and multiple machine modules arranged below the spinning unit 1, wherein three machine modules 5.1, 5.2, and 5.3 arranged next to each other are illustrated in this example embodiment as examples. The machine modules 5.1, 5.2, and 5.3 include multiple processing assemblies 8 for drawing and curling a thread, and a spooling unit 9 for winding the thread.

The spinning unit 1 is divided into multiple spinning positions 1.1, 1.2, and 1.3, wherein one of the machine modules is associated with each spinning position. In this manner the spinning position 1.1 and the machine module 5.1 for one unit in order to produce a melt spun thread. The spinning position 1.2 and the machine module 5.2, and the spinning position 1.3 and the machine module 5.3 also each form one unit for producing a thread. In this regard the spinning, drawing and texturing machine illustrated in FIGS. 1 and 2 is suitable to produce three threads in parallel. In order to obtain a spinning unit that is as compact as possible, and having a low expenditure of energy for tempering the melt carrying components, and in order to obtain a large utilization of space with the setup of such spinning, drawing and texturing machines on the other hand, the processing assemblies 8 and the spooling units 9 within the machine modules 5.1, 5.2, and 5.3 are arranged in relation to one another such that a very narrow machine partition of <800 mm occurs on the longitudinal side. The machine partition, which is entered in FIG. 1 as the reference symbol T, determines the formation of the spinning positions 1.1, 1.2, and 1.3 such that the space requirement for the production of a thread is substantially defined by the machine partition. Depending on whether a composite thread, or an individual thread is produced as a thread in the spinning position, the machine modules 5.1, 5.2, and 5.3 and the spinning positions 1.1, 1.2, and 1.3 may also be arranged in regions of ≦600 mm.

In the example embodiment of the spinning, drawing and texturing machine illustrated in FIG. 1 multiple individual threads are each extruded per spinning position 1.1, 1.2, and 1.3, which are then combined to one thread within the machine modules by means of swirling or curling.

The spinning unit has three spinnerets 2.1, 2.2, and 2.3 per spinning position, which are held at the bottom of the heated spinning beam 6. For this purpose the spinning beam 6 extends across all spinning positions 1.1, 1.2, and 1.3. The spinning beam 6 is connected to multiple melt sources (not illustrated) via multiple melt feeds 7.1, 7.2, and 7.3. One polymer melt is provided by each of the melt sources, wherein the polymer melt is distributed to the individual spinnerets 2.1, 2.2, and 2.3 of the spinning position 1.1, 1.2, and 1.3 via the melt feeds 7.1, 7.2, and 7.3, and via the distribution system (not illustrated) situated within the spinning beam 6, and having associated spinning pumps. In this manner, for example, differently dyed polymer melts can be extruded in the spinnerets 2.1, 2.2, and 2.3 in order, for example, to produce a so-called tricolor thread per spinning position 1.1, 1.2, and 1.3, as is commonly required for the production of carpet.

A cooling device 3 is arranged below the spinning beam 6, each interacting with one spinning duct 4. For this purpose each spinning position 1.1, 1.2, and 1.3 has a spinning duct 4, which has a cone-shaped outlet. The cooling device 3 includes a pressure chamber 50, which is coupled to the spinning duct 4 via a blowing wall 51 such that cooling air flow directed transversely is created for cooling the freshly extruded filaments. For this purpose the pressure chamber 50 is connected to a coolant source that is not illustrated. It should be mentioned at this point that other cooling principles not illustrated herein may also be utilized for cooling the filaments within the spinning duct. For example, so-called blowing candles, wherein a cooling air flow directed from the interior to the exterior is created, may also be utilized for cooling.

The machine modules 5.1, 5.2, and 5.3 are arranged below the spinning ducts 4. Each of the machine modules 5.1, 5.2, and 5.3 is embodied identically such that the construction can be explained based on the example of the machine module 5.1.

The machine module 5.1 has a rack wall 26, on which multiple processing assemblies 8 and a spool-out unit 9 are held in a protruding manner. The processing assemblies 8 are substantially formed by a preparation unit 8.1, a drawing unit 8.2, a curling unit 8.3, and a relaxing unit 8.4, which are substantially held below one another on the rack wall 26. For this purpose the components of the processing assemblies 8 critical for the thread guide protrude on a front of the rack wall 26. The electric drives and controls are associated with the processing assemblies 8 on the opposite side on the rear of the rack wall 26.

The preparation unit 8.1, which may be embodied, for example, as a pin preparation, or as a roller preparation, is directly associated with the outlet of the spinning duct 4, and is combined with a manifold thread guide 11, which guides the individual threads via the thread guide 10 for introduction into the machine module 5.1.

The drawing unit 8.2 is connected downstream of the preparation unit 8.1, wherein the drawing unit is formed by means of a take-off godet duo 14 and a drawing godet duo 15. The take-off godet duo 14 and the drawing godet duo 15 each of two driven godets, on the circumference of which the individual threads are guided. The curling unit 8.3 is positioned subsequent to the drawing unit 8.2, wherein the curling unit contains a texturing nozzle 16 and a cooling drum 17. The individual threads are textured into a mutual thread within the texturing nozzle 16, and cooled as a thread plug at the circumference of the cooling drum 17.

After cooling the thread is released from the thread plug, and fed to the spooling unit 9 via the relaxing unit 8.4. The relaxing unit 8.4 includes multiple relaxing godets 18.1 and 18.2, which are embodied by a driven godet having an associated spillover roller. A swirling unit 19 is arranged between the relaxing godets 18.1 and 18.2 in order to compact the thread before spooling.

It should be mentioned at this point that a second swirling unit may preferably be arranged between the preparation unit 8.1 and the drawing unit 8.2 in order to carry out a swirling process of the individual threads. In this manner the preparation application on the individual multifilament threads can be equalized and the mixing of the individual threads can be influenced during texturing.

The spooling unit 9 is also held at the rack wall 26. For this purpose the rack wall may be embodied as one part, or in multiple parts within the machine module 5.1. The spooling unit 9 has two driven spool spindles 21.1 and 21.2 for winding the thread, which are held on a pivoting spindle carrier 20. The spool spindles 21.1 and 21.2 are guided between an operating position and a changing position by means of the spindle carrier 20 in an alternating manner. The spool spindles 21.1 and 21.2 interact with a pressure roller 23 and a changing unit 22 in the operating position in order to wind a thread 24 onto a spool 25.

The machine modules 5.1, 5.2, and 5.3 are arranged next to one another, thus forming a longitudinal side of the machine, on which the processing assemblies 8 and the spooling units 9 are held next to one another. An operating platform 27 is arranged on the front of the rack wall 26 for operating the processing assemblies 8, wherein the operating platform extends across the entire length of the longitudinal side of the machine such that an operator may carry out all required operating processes for starting the thread, or for the maintenance of the processing assemblies. In this manner the threads escaping from the spinning duct 4 during spinning can be caught, for example, by a manually guided intake, and successively placed into the processing assemblies 8 and the spooling unit 9 at the machine module. For this purpose the operating platform 27 is raised in order to be able to carry out all work operations at the machine module 5.1, 5.2, or 5.3 from one position. In the example embodiment illustrated in FIGS. 1 and 2 the operating platform 27 is arranged at a plane extending between the processing assemblies 8 and the spooling unit 9. In this manner a free space is formed below the operating platform 27 for exchanging the spools on the spooling unit 9. The spool exchange on the spooling units of the machine modules 5.1, 5.2, and 5.3 is carried out fully automatically by means of a doffer unit 28. For this purpose the doffer unit has multiple spool changing devices 29, wherein one spool changing device 29 is associated with each spooling unit 9. The spool changing devices 29 interact with a spool transport unit 30, by means of which the spools are transported away. In this example embodiment the spool transport unit 30 is formed by a spool holder 47, which is guided at a suspension track 48. The spool holder 47 can be optionally placed in a transfer position directly in front of the spool changing devices 29 such that a full spool can be transferred from the spool changing device 29. The spool changing device 29 is formed by means of a turnstile pivoting arm system 42 and a sleeve magazine 40. Such a system is described, for example, in the German patent application 10 2006 010 855 (not yet published). Express reference is therefore made to the cited printed publication, and no further explanations are provided at this point.

In order to obtain high flexibility in utilizing the spinning, drawing and texturing machine the processing assemblies and spooling units 9 held at the machine modules 5.1, 5.2, and 5.3 are driven and controlled independently of each other. For this purpose the drive and control electronics of the machine modules 5.1, 5.2, and 5.3 are each separately combined to one electronic component 35, and are each associated with the machine module 5.1, 5.2, or 5.3. FIG. 2 shows the situation for the machine module 5.1. For this purpose the electronic component 35 is held on the rear of the rack wall 26. The godet drives 31.1, 31.2, 31.3, the roller drive 32 of the cooling drum, the changing drive 33 of the changing unit 22, and the spindle drives 34.1 and 34.2 of the spool spindles 21.1 and 21.2, and the rotary drive 53 of the spindle carrier 20 are connected to the electronic component 35. Furthermore, additional actuators and sensors may be associated with the processing assemblies, which are also linked to the electronic component 35. A control unit 37 is associated with the electronic component 35 for the controls, which is coupled to an operating panel 36. The operating panel 36 is held on the front of the rack wall 26. In this manner the functions of all processing assemblies can be activated via the operating panel 36 by an operator. In order to coordinate all positions within the spinning, drawing and texturing machine, the control unit 37 is coupled to a main control unit 39, by means of which superordinate control commands and settings can be entered.

It is also possible to connect the control unit 37 to an operating device 38 in a wireless manner. In this manner settings and processing data or product parameters can be displayed on the operating device 38. However, it is also possible to establish settings changes in the processing assemblies and control commands of the control unit 37. For this purpose the control unit 37 has a remote control module in order to receive and send signals.

In the spinning, drawing and texturing machine illustrated in FIG. 1 and FIG. 2, the drives and actuators of the spinning device are controlled separately, and are coupled to a control unit 37 via a central main control unit 39. For this purpose it is necessary that the spinning position 1.1, 1.2, or 1.3 associated with the respective machine module 5.1, 5.2, or 5.3 can be continuously operated without interruption in case of a process interruption, for example due to the formation of windings. For this purpose a thread cutter 12 and an intake 13 are provided on each machine module 5.1, 5.2, and 5.3 in the region of the infeed. The intake 13 is coupled to a suctioning device 49, by means of which one or multiple suctioned in threads can be continuously fed to a refuse bin. In this manner an interruption during the extrusion of the threads is not necessary in case of a process interruption due to a tearing of the thread or the formation of a winding. Multiple spinning positions can be combined for supplying the spinnerets 2.1, 2.2, and 2.3 such that extensive distribution systems and additional spinning pump units can be omitted. However, it is also possible to control a spinning position independently of adjacent spinning positions in order to, for example, adjust a reduced delivery rate of the melt during a process interruption.

The example embodiment of the spinning, drawing and texturing machine according to the invention illustrated in FIGS. 1 and 2 is therefore particularly suited to produce a plurality of composite threads parallel next to one another at high flexibility from melt spinning to spooling. For this purpose the selection of the processing assemblies held at the machine modules is provided as an example only in FIGS. 1 and 2. Generally, additional treatment steps can be carried out, such as a pre-swirling of the thread immediately after preparation, or alternate treatment steps, such as a multiple drawing without texturing. It is also possible to carry out groups of machine modules in various embodiments of the processing assemblies and treatment steps in a complete system having a plurality of machine modules. In this manner different types of thread can be produced using a spinning, drawing and texturing machine.

Figure 3:
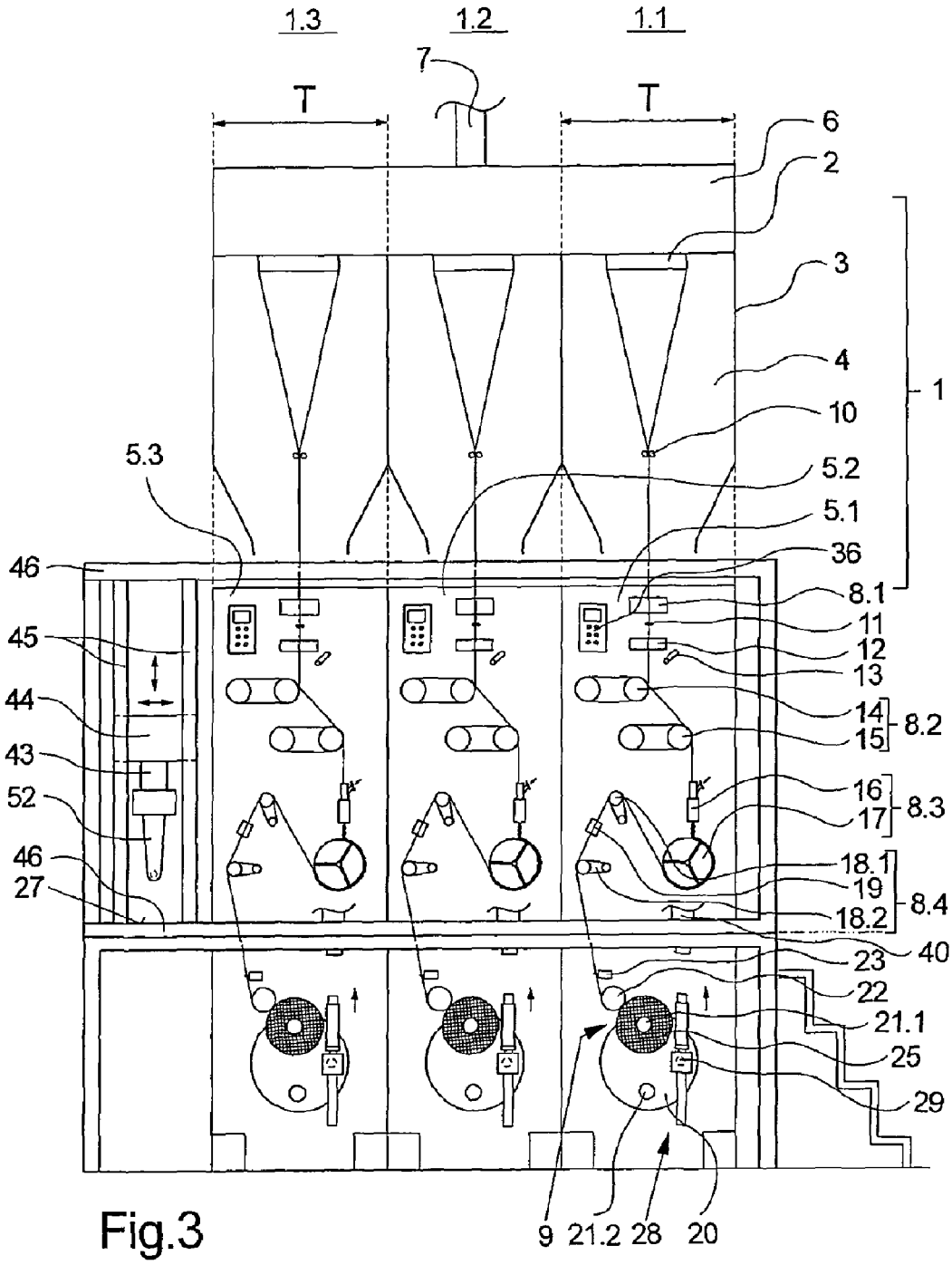

Another example embodiment of the device according to the invention is illustrated in multiple views in FIGS. 3 and 4. For this purpose the spinning, drawing and texturing machine is shown in a front view in FIG. 3, and in a side view in FIG. 4. The example embodiment according to FIGS. 3 and 4 is substantially identical to the example embodiments according to FIGS. 1 and 2 such that reference is made to the previous description at this point, and merely the differences are explained below.

In the example embodiment of the spinning, drawing and texturing machine according to the invention illustrated in FIGS. 3 and 4 the spinning unit 1 has only one spinneret 2 per spinning position 1.1, 1.2, and 1.3. The spinnerets 2 of the spinning positions 1.1 and 1.2 and 1.3 are held at the bottom of the spinning beam 6, and are supplied with a polymer melt provided by a melt source via a melt feed 7. The cooling device 3 and the spinning ducts 4 interacting with the cooling device 3 arranged below the spinning beam 6 are embodied identical to the previous example embodiment such that one thread each is extruded per spinning position 1.1, 1.2, and 1.3 in the spinning unit, and is subsequently prepared, drawn, curled, relaxed and wound to a spool at the machine module 5.1, 5.2, and 5.3.

A robot 43 is provided in order to be able to start the thread at the processing assemblies 8 of the machine module 5.1, 5.2, or 5.3 before the start of the process, or after a process interruption. For this purpose the robot 43 is held at a carrier 44 that is movably coupled to a carrier rack 45. The carrier rack 45 is held in the upper and lower rack guide, which extends at a distance in front of the longitudinal side of the machine substantially across the entire length of the longitudinal side of the machine. The carrier rack 45 can therefore be guided at the rack guide 46 along the longitudinal side of the machine. In order to start a threading process at one of the machine modules 5.1, 5.2, and 5.3 the carrier rack 45 is guided to the respective machine module. The carrier 44 having the robot 43 can be guided in vertical direction on the carrier rack 45 within the machine module such that the robot 43 may perform the threading operation at the processing assemblies 8 using a multiaxial robot arm 52. For this purpose the robot arm 52 has an intake at the free end thereof, by means of which the extruded threads can be taken up from the spinning unit 1.1, 1.2, or 1.3 after the start of spinning. Subsequently, the starting process is performed up to the spooling unit via a robot control.

In this manner a fully automatic operation of the spinning, drawing and texturing machine can be realized, wherein the spool exchange and the spool transport are carried out at a lower plane by means of the doffer unit 28. For this purpose the doffer unit 28 is embodied identical to the previous example embodiment according to FIGS. 1 and 2.

In this case the operating platform 27 arranged above the doffer unit 28 is preferably utilized for maintenance work on the processing assembly.

The example embodiments of the spinning, drawing and texturing machine according to the invention illustrated in FIGS. 1 to 4 are examples of the construction and arrangement of the processing assemblies and of the spooling unit. In this regard the compact design of the machine modules achieved by the arrangement of the vertically aligned processing assemblies and the spooling unit is of importance such that compact machine arrangements can be realized even with a one thread spooling, which combine simple and easy operability at a maximum of flexibility. Particularly the failure rates, and thus the process interruptions that are unavoidable during a production, can be reduced to a minimum, since only one spinning position, and thus only one thread is affected in case of the formation of a winding, or the tearing of a thread. So-called sympathy thread breakages, such as are known in current spinning units, are avoided completely.

In this manner uncurled drawn or partially drawn threads may also be advantageously produced depending on the composition and selection of the processing assemblies.

The number and embodiment of the godets in the drawing units shown in the example embodiments can be basically freely selected. The design of the drawing unit depends on the production process and on the type of thread. Furthermore, the thread guide within the machine having a single thread and of the spooling unit results in a gentle and uniform thread quality, since any deflections for combining or spreading apart, which are usually inherent in thread tension changes, thus leading to changes in the physical properties, are avoided. A gentle and uniform production of the threads is therefore ensured.

LIST OF REFERENCE SYMBOLS

1 spinning unit
1.1, 1.2, 1.3 spinning position
2.1, 2.2, 2.3 spinneret
3 cooling device
4 spinning duct
5.1, 5.2, 5.3 machine module
6 spinning beam
7 melt feed
8 processing assembly
8.1 preparation unit
8.2 drawing unit
8.3 curling unit
8.4 relaxing unit
9. spooling unit
10 thread guide
11 manifold thread guide
12 thread cutter
13 intake
14 take-off godet duo
15 drawing godet duo
16 texturing nozzle
17 cooling drum
18.1, 18.2 relaxing godet
19 swirling unit
20 spindle carrier
21.1, 21.2 spool spindle
22 changing unit
23 pressure roller
24 thread
25 spool
26 rack wall
27 operating platform
28 doffer unit
29 spool changing device
30 spool transport unit
31.1, 31.2, 31.3 godet drive
32 roller drive
33 changing drive
34.1, 34.2 spindle drive
35 electronic component
36 operating panel
37 control unit
38 operating device
39 main control unit
40 sleeve magazine
42 turnstile pivoting arm system
43 robot
44 carrier
45 carrier rack
46 rack guide
47 spool holder
48 suspension track
49 suctioning device
50 pressure chamber
51 blowing wall
52 robot arm
53 rotary drive

What is claimed is:

1. A spinning, drawing and texturing machine for the production of curled threads, comprising:

a spinning unit and multiple machine modules disposed beneath the spinning unit, wherein the spinning unit is constructed and arranged to provide multiple sets of melt feeds, wherein each of the machine modules has (i) multiple processing assemblies for drawing and curling a respective set of melt feeds provided by the spinning unit into a single curled thread and (ii) a spooling unit for winding only that single curled thread to prevent sympathy breakage of an adjacent curled thread, wherein the machine modules are positioned next to one another to form a longitudinal side of the machine, wherein, for each of the machine modules, the multiple processing assemblies of that machine module are disposed within a narrow machine partition (T) in a range of <800 mm along the longitudinal side of the machine, wherein the spinning unit has multiple sets of spinnerets and multiple spinning ducts, each of the machine modules receiving its respective set of melt feeds from a respective set of spinnerets and a respective spinning duct which are disposed within the narrow machine partition (T) associated with that machine module, and wherein the spinnerets are held in rows parallel to the longitudinal side of the machine.

2. The spinning, drawing and texturing machine according to claim 1, wherein a raised operating platform is embodied at the longitudinal side of the machine directly in front of the machine modules, which extends substantially across the entire length of the longitudinal side of the machine.

3. The spinning, drawing and texturing machine according to claim 1, wherein the operating platform is embodied at a plane above the spooling units, wherein a doffer unit is associated with the spooling units for removing and transporting the spools, and wherein the operating platform defines a heightened operator isle providing access to the processing assemblies of the machine modules, the operating platform inhibiting access to the doffer unit from the heightened operator isle.

4. The spinning, drawing and texturing machine according to claim 3, wherein the spooling units of the machine modules are constructed and arranged to be driven and controlled independently of one another, and wherein each of the spooling units winds one curled thread to a spool.

5. The spinning, drawing and texturing machine according to claim 4, wherein the spooling units each have two drivable spool spindles for the alternating receiving of the spool, the two drivable spool spindles of each spooling unit being disposed at a height which is lower than the operating platform, and each spooling unit being constructed and arranged to limit winding to exactly one curled thread at a time.

6. The spinning, drawing and texturing machine according to claim 4, wherein the doffer unit is formed by means of multiple stationary spool changing devices associated with the spooling units, and a spool transport unit, the multiple stationary spool changing devices and the spool transport unit being disposed at a height which is lower than the operating platform, each stationary spool changing device being constructed and arranged to change exactly one spool at a time.

7. The spinning, drawing and texturing machine according to claim 1, wherein the processing assemblies of the machine modules are constructed and arranged to be driven and controlled independently of each other.

8. The spinning, drawing and texturing machine according to claim 1, wherein one electronic component is provided per machine module for receiving the drive and control electronics associated with the processing assemblies and the spooling unit.

9. The spinning, drawing and texturing machine according to claim 8, wherein each electronic component has a remote control unit, and wherein the control units are constructed and arranged to be controlled separately via a mobile operating device.

10. The spinning, drawing and texturing machine according to claim 1, wherein each machine module has one rack wall which supports the processing assemblies and the spooling unit of that machine module relative to one another on a front side, the one rack wall supporting the spooling unit below the processing assemblies, and wherein the rack wall of each machine module is constructed and arranged to carry electronic components which drive and operate only the processing assemblies and the spooling unit of that machine module.

11. The spinning, drawing and texturing machine according to claim 1, wherein a suctioning device is associated with the machine modules, which suctioning device for each machine module each has an intake associated with the processing assemblies.

12. The spinning, drawing and texturing machine according to claim 1, further comprising:

a robot that is movably arranged to translate horizontally on the longitudinal side of the machine to individually access the processing assemblies of each machine module, the robot being constructed and arranged to carry out the starting of a thread for the process start and/or after process interruption using a movable robot arm.

13. The spinning, drawing and texturing machine according to claim 12, wherein the robot is held on a movable carrier supported by a carrier rack and rack guide, the carrier rack and rack guide being constructed and arranged to (i) guide the movable carrier in a vertical plane parallel to the longitudinal side of the machine to provide the robot with access to the processing assemblies of the machine modules, and (ii) restrict the movable carrier from interfering with the spooling units of the machine modules.

14. The spinning, drawing and texturing machine according to claim 1, wherein the processing assembly for drawing the thread within the machine module is formed by at least two driven godets, and wherein the thread is drawn through the first godet from the spinning unit.

15. Apparatus to produce multiple curled threads, the apparatus comprising:

a spinning unit constructed and arranged to provide multiple sets of melt feeds and having spinnerets and spinning ducts; and machine modules disposed in a side-by-side arrangement with respect to each other along an axis and disposed adjacent the spinning unit, each machine module including:

a processing assembly constructed and arranged to draw and curl exactly one thread from a set of melt feeds received from a respective set of spinnerets and a respective spinning duct of the spinning unit to prevent sympathy breakage of an adjacent thread, and a spooling unit coupled to that processing assembly, the spooling unit being constructed and arranged to wind the exactly one thread;

wherein the processing assembly and the spooling unit of each machine module has a width (T) in a range of 800 mm along the axis;

wherein the respective set of spinnerets and the respective spinning duct, from which each processing assembly draws and curls exactly one thread, has the width (T) in the range of 800 mm along the axis; and wherein each set of spinnerets is held in a row which is substantially parallel to the axis.

16. The apparatus of claim 15 wherein the processing assembly of each machine module includes:

a curling unit disposed between the spinning unit and the spooling unit of that machine module, the curling unit being constructed and arranged to curl the thread, from a respective set of melt feeds, after the thread is drawn and prior to winding the thread.

17. The apparatus of claim 16 wherein the set of melt feeds includes multiple melt feeds; and wherein each curling unit includes (i) a texturing nozzle constructed and arranged to texture the multiple melt feeds into a mutual thread, and (ii) a cooling drum constructed and arranged to cool the mutual thread prior to winding.

18. The apparatus of claim 17 wherein the processing assembly of each machine module further includes:

a relaxing unit having a set of relaxing godets and a set of swirling units which are constructed and arranged to relax and swirl the mutual thread prior to winding.

19. The apparatus of claim 18 wherein the spooling unit of each machine module includes multiple spool spindles, and wherein the apparatus further comprises:

a platform disposed at a height between that of the relaxing units of the processing assemblies of the machine modules and that of the spool spindles of the spooling units of the machine modules to divide access between the processing assemblies of the machine modules and the spooling units of the machine modules.

20. The apparatus of claim 18, further comprising:

a robot constructed and arranged to automatically start thread processing on the processing assembly of each machine module; and a rack assembly constructed and arranged to move the robot from one machine module to another machine module horizontally along the axis to position the robot to automatically restart thread processing on one machine module while thread processing continues on another machine module.

* * * * *